United States Patent [19]

Takenouchi

[11] 4,131,795

[45] Dec. 26, 1978

[54] INSTANT RADIATION IMAGE DISPLAY ELEMENT

[75] Inventor: Mutsuo Takenouchi, Ebina, Japan

[73] Assignee: Fuji Xerox Co., Ltd., Tokyo, Japan

[21] Appl. No.: 776,809

[22] Filed: Mar. 11, 1977

[30] Foreign Application Priority Data

Mar. 13, 1976 [JP] Japan ..... 51-27303

[51] Int. Cl.[2] ..... G03G 13/00; H01J 31/49

[52] U.S. Cl. ..... 250/315 A; 250/331

[58] Field of Search ..... 250/315 A, 331; 350/160 LC

[56] References Cited

U.S. PATENT DOCUMENTS

| | | | |
|---|---|---|---|
| 3,732,429 | 5/1973 | Braunstein et al. | 250/331 X |
| 3,824,002 | 7/1974 | Beard | 250/331 X |
| 3,939,345 | 2/1976 | Allan et al. | 250/315 A |
| 3,965,352 | 6/1976 | Allan et al. | 250/315 A |

*Primary Examiner*—Alfred E. Smith
*Assistant Examiner*—Janice A. Howell
*Attorney, Agent, or Firm*—Sughrue, Rothwell, Mion, Zinn and Macpeak

[57] ABSTRACT

An instant image display element for X-rays or the like comprises a laminate of an optically transparent plate 3, an optically transparent electrode 4, a deformable elastomer layer 5, a flexible insulating mirror film 6, an ionizable liquid 7 which absorbs X-rays and emits positive and negative ions in proportion to the ray intensity, and an X-ray permeable plate electrode 8. When a potential is developed across the electrodes 4, 8 and an X-ray pattern is projected through electrode 8 and into the liquid 7, the emitted ions of one polarity migrate to the mirror film 6, and cause the elastomer layer 5, and the mirror film 6 along with it, to deform in a pattern corresponding to the X-ray pattern. Such deformation may be optically projected for readout by a Schlieren system or the like.

8 Claims, 4 Drawing Figures

INSTANT RADIATION IMAGE DISPLAY ELEMENT

BACKGROUND OF THE INVENTION

This invention relates to a deformable, radiation image display element, particularly adapted to be used in connection with an X-ray apparatus.

In conventional radiation imaging apparatuses, such as an X-ray apparatus, the medical diagnosis of human body ailments or the non-destructive inspection of objects is performed after transforming the radiation image of the body or object into a permanent hard copy form by the use of an X-ray silver salt film or xeroradiography. Accordingly, considerable time is required to obtain a visually usable output from an X-ray irradiation, and such delay is at the least inconvenient and at the most even dangerous in an emergency situation.

An instant photographic image display device has been developed in the prior art, as shown in FIG. 1 and disclosed in detail in Japanese patent application Ser. No. 13189/1972. In this device, an electrostatically deformable element 16 is fabricated by covering a transparent base plate 11 with a laminate which consists sequentially of a transparent electrically conductive layer 12, a photoconductive layer 13, and a deformable elastomer layer 14. When this element is exposed to an optical image 15, with the transparent conductive layer 12 being grounded and a uniform charge distribution 17 being imparted to the surface of elastomer layer 14, then an electrostatic charge distribution corresponding to the image pattern is formed on the interface between the elastomer layer 14 and the photoconductive layer 13. Simultaneously, the optically exposed portions of the surface of the elastomer layer 14 are deformed as equilibrium is established between the electrostatic force and the elasticity of the elastomer. The deformation image thus obtained on the surface of the elastomer layer 14 is visually viewable by the use of a Schlieren optical system or other suitable readout system as illustrated in FIG. 3. In such a system, when light is radiated from a source L through suitable lenses onto the surface of an elastomer layer where a deformation image has been formed at a position labeled E, a visual reproduction of the optical image is obtained on a projection screen 9.

SUMMARY OF THE INVENTION

The principal object of the present invention is therefore to provide means for enabling the display of a radiation image, such as an X-ray image, substantially simultaneously with the irradiation of a body or object, thus eliminating the necessity of converting the image into hard copy form.

Another object of the invention is to enable the visual enlargement of the radiation image to a desired size.

Another object of the invention is to enable the selection of either frost-mode deformation with satisfactory halftone reproducibility, or relief-mode deformation with very fine edge effect or resolution by properly selecting the materials of the elastomer layer. Still another object is to provide a repeatedly usable radiation image display element.

DESCRIPTION OF THE PREFERRED EMBODIMENTS

Figure 1:
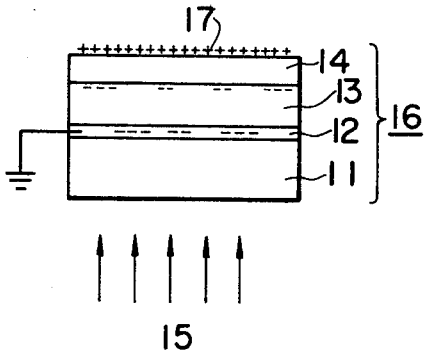
FIG. 1 PRIOR ART
FIG. 1 shows a cross-sectional view of a conventional optical image display elastomer element of the prior art, FIG. 2 schematically illustrates a radiation image display elastomer element of the present invention, with the disposition of a subject and X-rays.
Figure 2:
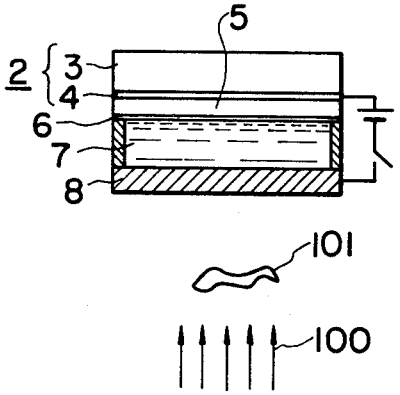

The essence of the present invention resides in the conversion of a radiation image into a deformation image on an elastomer layer, and it will be described in detail with reference to an embodiment shown in the accompanying drawings. As illustrated in FIG. 2, an optically transparent conductive base plate 2 consisting of a transparent plate 3 and a transparent electrode 4 is covered with an elastomer layer 5 and a flexible insulating reflecting film 6. A plate electrode 8 having high radiation or radiant-ray permeability is spaced opposite the film 6, between which a radiation absorptive liquid 7 containing heavy atoms of atomic number above 17 is enclosed.

Figure 3:
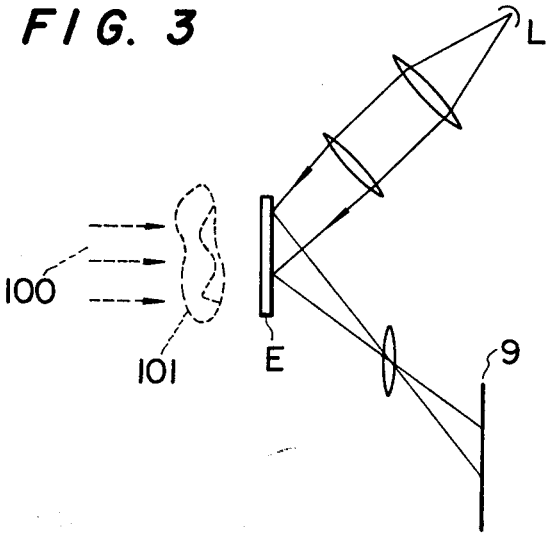
FIG. 3 shows an exemplary optical system for the projection of a deformation image formed on the radiation image display elastomer element of FIG. 2.

Utilizing either the frost-mode or relief-mode deformation of the elastomer, the image can be enlarged and projected by means of a Schlieren optical system or the like as shown in FIG. 3.

According to the operating principle of the elastomer image-forming element of the present invention, a radiation image is directed against plate electrode 8 while an electric field is being applied across the liquid 7. The latter absorbs and is ionized by the radiant rays and emits positive ions and electrons, or pairs of positive and negative ions, in proportion to the ray intensity. An electrostatic latent image composed of the emitted electrons or ions is thus formed on the insulating reflecting film, and the elastomer 5 is simultaneously deformed by the electrostatic force to produce the desired physical image of the radiation pattern.

The amount of the electric charge required to cause deformation of the elastomer depends on the dielectric constant, thickness and rigidity of the elastomer. In the case of an elastomer having a dielectric constant of 2, a thickness of 5 microns and a rigidity of $10^4$ dyn/cm$^2$, charging must be so performed as to produce a surface potential of approximately 300 volts. A suitable type of radiation absorptive liquid 7 to be enclosed in the elastomer display element contains heavy atoms in compounds such as $CCl_4$, $CCl_3Br$ or $CCl_3I$. In principle, however, any radiation absorptive liquid is usable if it provides a sufficient amount of electric charge to cause deformation of the elastomer. When the element of the present invention is fabricated for X-ray use, the transparent conductive base plate 2 comprises a substance having a surface resistance of $10^3$ ohms or less such as Nesa glass or an acrylic plate whose surface is treated to render it conductive. The elastomer layer 5 is formed into a hardened film having a thickness of 2 to 5 microns through a dip coating process or the like by the use of a silicone resin (SH1820 made by Toray Company) diluted with a hydrocarbon solvent. The flexible insulating reflecting film 6 is formed thereon by evaporating indium to a thickness of 300 angstroms or less. The liquid layer 7 is 1 to 2 mm in thickness and comprises, for example, $CCl_4$, $CCl_3Br$, $CH_2I_2$, $CHFI_2$ , $CCl_3I$, $CH_2BrI$ or $CH_2ClI$. The electrical resistance of the X-ray absorptive liquid 7 should be greater than $10^{13}$ Ω-cm; a resistance below this value is generally not acceptable since the storage of the deformation image is not ensured. The X-ray permeable plate electrode 8 comprises an acrylic plate treated for conduction with aluminum or beryllium, thereby forming a multilayer sandwich structure to constitute the element.

Figure 4:
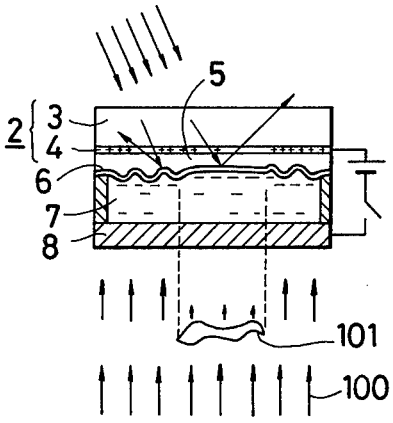
FIG. 4 shows the operation of the radiation image display elastomer element of FIG. 2 with the exemplary optical system of FIG. 3.

To display an X-ray image by the use of this element, first X-rays 100 are irradiated onto a subject 101, as shown in FIG. 4. The X-rays having passed through the subject 101 are absorbed via the plate electrode 8 into the X-ray absorptive liquid 7, where they ionize the liquid compound molecules to cause the release of positive and negative ions. If the plate electrode voltage is negative, a negative charge distribution corresponding to the X-ray image is formed on the flexible insulating reflecting film 6. That is, the negative ions emitted by the liquid are attracted by the positively charged electrode 4, and migrate to the surface of the film 6. They cannot pass through the film since it is insulatory, and the heavy atomic weight of the ions tends to retard their recombination as long as the potential is maintained across the electrodes. Simultaneously, an image forming electrostatic force is exerted as a contractile force on the elastomer layer 5 in accordance with the charge density. The deformation of the elastomer layer 5 is held due to equilibrium between the contractile force and the restoring force of the elastomer, and the reflecting film 6 is correspondingly deformed, thereby producing a physical difference between the deformed portions or areas and the undeformed portions with respect to their light scattering characteristics. In other words, the X-ray image having passed through the subject 101 is converted into an elastomer deformation image and/or a mirror image of different light scattering characteristics, as shown in FIG. 4. The deformation image thus obtained can be enlarged and projected, as mentioned above with regard to FIG. 3, by means of Schlieren or other optical system. It is possible to hold the deformation image for more than ten minutes after the radiation is terminated with the proper selection of component materials, so that the element is quite applicable for direct display in human body diagnosis or nondestructive object inspection. Moreover, the image is easily convertible into hard copy form by the disposition of a surface-charged electrophotographic recording sheet of zinc oxide or the like on the projection screen 9. It has already been mentioned that excellent edge resolution is achieved by using a relief-mode deformation of the elastomer. However, it is also possible to obtain a deformation image in a frost mode by using a base plate 2 whose conductive layer 4 is formed into a striped or dotted arrangement. The pitch of such a frost-mode image is determined by the period of the stripes or dots. Although an element with a soft elastomer may be used in the practice of the invention, the repetition life of the element may be extended by using a hard elastomer.

As described above, the present invention is not limited by the hardness of the elastomer. Similarly, the specific parameters disclosed for the transparent conductive base plate, elastomer layer, insulating mirror layer, X-ray absorptive liquid and X-ray permeable plate electrode may easily be varied without departing from the concept of the present invention, and the same is also true with respect to the means for projection and voltage application.

Some specific examples of the invention will now be described.

EXAMPLE 1

A solution was prepared by mixing 1 gram of a hardening agent with 10 grams of a silicone resin (SH1820 made by Toray Company), and then mixing therewith 5.5 grams of 10 cst silicone oil and 6.6 grams of isooctane, and further adding n-pentane thereto until the amount of the total solution reached 50 cc. Nesa glass (Type S transparent conductive glass made by Matsuzaki Vacuum Company) was drawn out from this solution at a speed of 10 cm/min to form an insulating deformable layer (elastomer layer) with a thickness of several microns. Prior to hardening for several hours in an oven at 150° C., indium was evaporated thereon to form a flexible insulating reflecting film of 200 angstrom thickness having a mirror surface. After placing a liquid tight spacer or sidewall enclosure of 1 mm depth thereround, $CCl_4$ was injected and sealingly enclosed by an aluminum plate of 3 mm thickness, the latter forming the plate electrode 8. The element thus obtained was set at position E in the optical readout system of FIG. 2, and when X-rays were irradiated through a subject toward the aluminum plate electrode, an image of the penetrating X-rays was displayed on the projection screen 9.

EXAMPLE 2

To form a reflecting film on the element provided with an elastomer as in Example 1, silver and chromium were evaporated alternately in the following manner. Chromium was first evaporated to a thickness of 14 angstroms, subsequently silver was evaporated to 190 angstroms, then chromium to 14 angstroms, silver to 190 angstroms, chromium to 28 angstroms, and silver to 190 angstroms, respectively. After interruption for 1 to 2 minutes, silver was evaporated to 320 angstroms, then chromium to 28 angstroms, and further silver to 190 angstroms to complete the evaporation. The image display element was then completed as in Example 1, and was found to perform satisfactorily.

Although the foregoing description covers the conversion and display of an X-ray image, it is possible to effect the same conversion and display with respect to an image of other radiant rays, such as $\beta$ rays.

What is claimed is:

1. A generally laminar radiation image display element comprising, in ordered sequence:
   (a) an optically transparent, electrically conductive base plate,
   (b) a deformable elastomer layer,
   (c) a flexible, electrically insulating, optically reflecting layer,
   (d) a radiation absorptive, ionizable liquid layer, and
   (e) a radiation permeable, electrically conductive plate.

2. A radiation image display element as defined in claim 1 further comprising means for applying an electrical potential across the plates defined in sub-paragraphs (a) and (e).

3. A radiation image display element as defined in claim 1 further comprising continuous edge wall means sealingly disposed between the reflecting layer and the radiation permeable plate to thereby define an enclosure for the liquid layer.

4. A radiation image display element as defined in claim 1 wherein the liquid layer is selected from the group consisting of $CCl_4$, $CCl_3Br$, $CH_2I_2$, $CHFI_2$, $CCl_3I$, $CH_2BrI$ and $CH_2ClI$.

5. A radiation image display element as defined in claim 1 wherein the base plate comprises an electrically conductive layer formed in striped or dotted pattern.

6. A radiation image display element as defined in claim 2 wherein the liquid layer is selected from the group consisting of $CCl_4$, $CCl_3Br$, $CH_2I_2$, $CHFI_2$, $CCl_3I$, $CH_2BrI$ and $CH_2ClI$.

7. A radiation image display element as defined in claim 3 wherein the liquid layer is selected from the group consisting of $CCl_4$, $CCl_3Br$, $CH_2I_2$, $CHFI_2$, $CCl_3I$, $CH_2BrI$ and $CH_2ClI$.

8. A radiation image display element as defined in claim 4 wherein the base plate comprises an electrically conductive layer formed in striped or dotted pattern.

* * * * *